US005522099A

United States Patent [19]

Heier

[11] Patent Number: 5,522,099

[45] Date of Patent: Jun. 4, 1996

[54] WASH WATER DRAINING DEVICE FOR WASHING PATIENTS IN BED

[76] Inventor: Dieter Heier, Am Auweg 6, D-61231 Bad Nauheim, Germany

[21] Appl. No.: 221,950

[22] Filed: Apr. 1, 1994

[30] Foreign Application Priority Data

Apr. 1, 1993 [DE] Germany ..... 43 10 661.7

[51] Int. Cl.[6] ..... A47B 13/00

[52] U.S. Cl. ..... 5/606; 5/615; 5/900; 5/660; 5/484; 4/485

[58] Field of Search ..... 5/606, 614, 615, 5/660, 509, 900, 928, 473, 484; 4/485, 446

[56] References Cited

U.S. PATENT DOCUMENTS

| | | | |
|---|---|---|---|
| 3,093,836 | 6/1963 | Christenson | 5/606 |
| 4,002,330 | 1/1977 | Johansson | 5/606 |
| 4,127,906 | 12/1978 | Zur . | |
| 4,434,517 | 3/1984 | Dorris | 4/585 |
| 4,527,298 | 7/1985 | Moulton | 5/615 |
| 4,807,313 | 2/1989 | Ryder | 5/615 |
| 4,819,925 | 4/1989 | Linnemann | 5/606 |
| 5,224,228 | 7/1993 | Larrimore . | |

FOREIGN PATENT DOCUMENTS

| | | | |
|---|---|---|---|
| 0509292 | 10/1992 | European Pat. Off. . | |
| 2690335 | 10/1993 | France . | |
| 2848461 | 5/1979 | Germany | 4/585 |
| 03965 | 7/1986 | WIPO | 5/615 |

*Primary Examiner*—Flemming Saether
*Attorney, Agent, or Firm*—Evenson, McKeown, Edwards & Lenahan

[57] ABSTRACT

A wash water draining device for washing patients in bed has a mattress base, which is formed, for example, by inflatable chambers and is disposed underneath a waterproof bed mattress and slopes the bed mattress from the sides to the center and from the head end to the foot end. A waterproof mattress pad is placed over the mattress and a mattress compressing device is attached centrally to the foot end of the mattress such that a drainage socket of the waterproof mattress pad can be embedded into the resulting and stabilized depression of the bed mattress.

8 Claims, 4 Drawing Sheets

WASH WATER DRAINING DEVICE FOR WASHING PATIENTS IN BED

BACKGROUND OF THE INVENTION

The invention relates to a wash water draining device for washing patients in bed. In particular, a wash water draining device for washing patients in bed for a waterproof bed mattress which can be deformed in the shape of a basin.

The washing and care of bedridden and frequently incontinent older persons requires a high degree of time and energy both in nursing homes and also when nursing at home. Here a wash water draining device for conventional bed mattresses represents significant help.

It is already known to fabricate such devices from inflatable pad-mouldings that are made of one piece (EP 509 292 A1). Furthermore, it is also known to equip deformable mattresses specifically with a drain (Patent Abstracts of Japan C-943, May 22, 1992, Vol. 16/No. 219).

SUMMARY OF THE INVENTION

In contrast, the present invention is based on the problem of overcoming the problem of the wash water draining device for conventional mattresses (i.e. with specially manufactured mattresses) by means of a waterproof pad.

This problem is solved by using a wash water draining device for washing patients in bed for a waterproof bed mattress which can be deformed in the shape of basin, the device comprising mattress bases which slop or deform the conventional bed mattress from the side to the center and from the head to the foot.

DETAILED DESCRIPTION OF THE PREFERRED EMBODIMENTS

Figure 1:
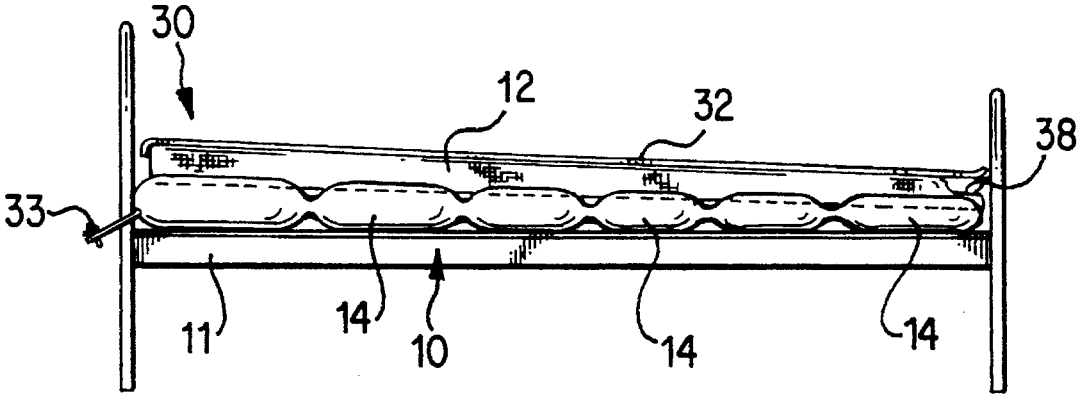
FIG. 1 is a schematic side elevational view of a bed showing a mattress and the device of the present invention.
Figure 2:
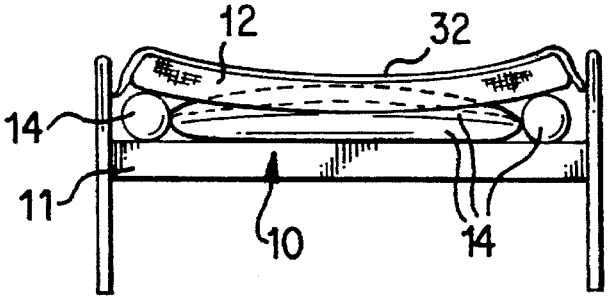
FIG. 2 is a schematic end elevational view of the combination shown in FIG. 1.
Figure 3:
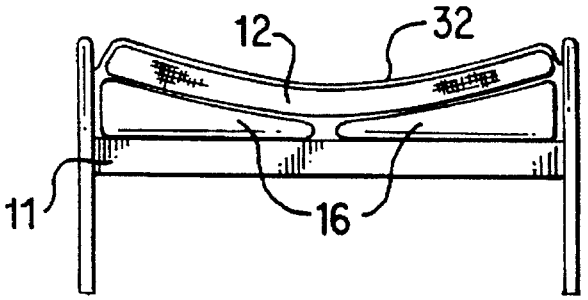
FIG. 3 is a schematic end elevational view showing another embodiment of the device of the present invention.
Figure 4:
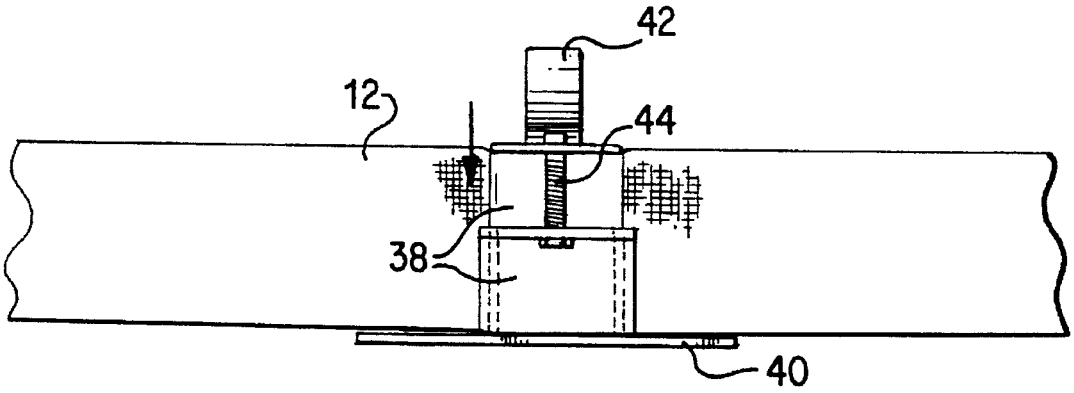
FIG. 4 is a traverse cross-sectional view of the mattress compressing device used in the present invention.
Figure 7:
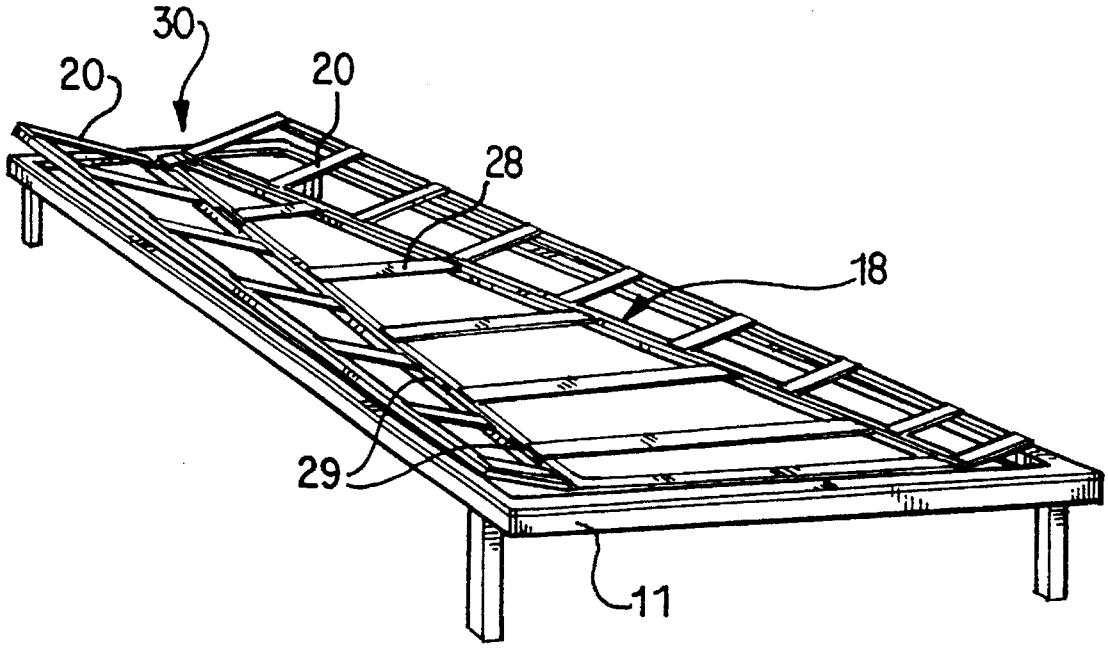
FIG. 7 is a perspective view showing another embodiment of the device of the instant invention.

The device comprises mattress bases (MU), which are laid in such a manner under the conventional bed mattress that said bed mattress slopes in the direction of both the central axis (FIGS. 2, 3 and 7) and the foot end (FIG. 1 ). The structure of these lateral bases can be analogous to that of an air mattress (LM), whose inflatable chambers (K) are designed in such a manner that they produce the aforementioned gradient of the bed mattress (BM) (FIGS. 1 and 2). The bases can also be foam pieces (ST), which are shaped in such a manner that the aforementioned gradient is produced on the conventional bed mattress (BM) (FIG. 3).

Figure 8:
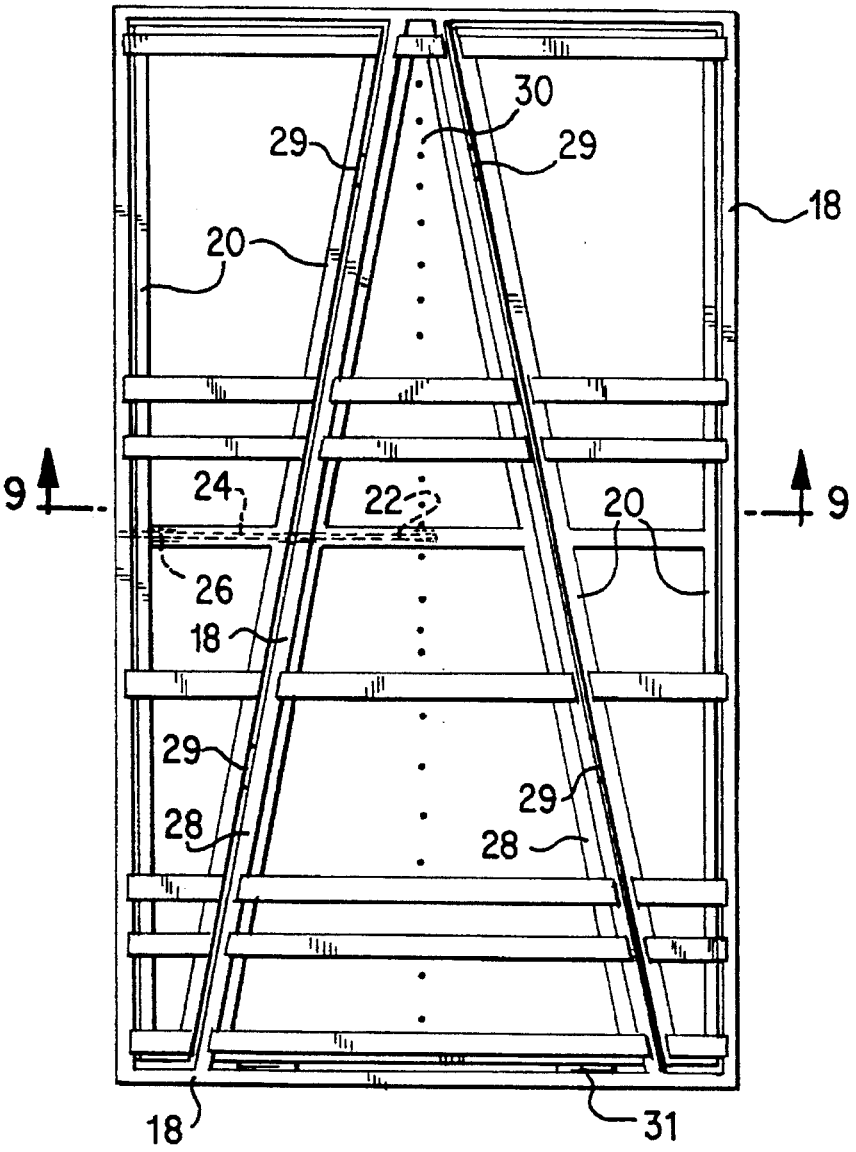
FIG. 8 is a plan view of the embodiment of FIG. 7.
Figure 9:
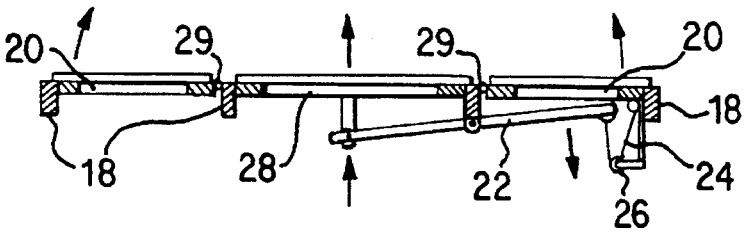
FIG. 9 is a cross-sectional view taken on the line A—A of FIG. 8.

A slatted base (LR) (FIGS. 7 and 8) represents another variation of the base; both sides of said slatted base can be folded up and stopped electrically or manually in such a manner that the conventional bed mattress (BM) slopes from the sides to the center and from the head to the foot piece. Folding up the side piece (LS) of a slatted base causes a lever (H) to be moved by means of a cord (SE), run over an anchored deflecting roller (U); said lever lifts the slatted base center piece (LM) in the head region (KO) (FIG. 9), in order to create in this manner an additionally stabilized gradient in the direction of the foot end even in the center region of the mattress.

The inflatable chambers (K) can remain permanently lying under the bed mattress (BM). As soon as the air is drawn off via valves, this device lies, analogous to a mattress protector, under the bed mattress (BM); only the tube valves (SV) remain accessible for the next washing of the patient.

The optionally usable foam pieces (ST) are usually removed after the patient has been washed. However, they can also be regarded as a guarantee that the patient cannot roll out and remain at least intermittently under the bed mattress (BM). The same applies to the folded-up slatted base (LR).

Figure 6:
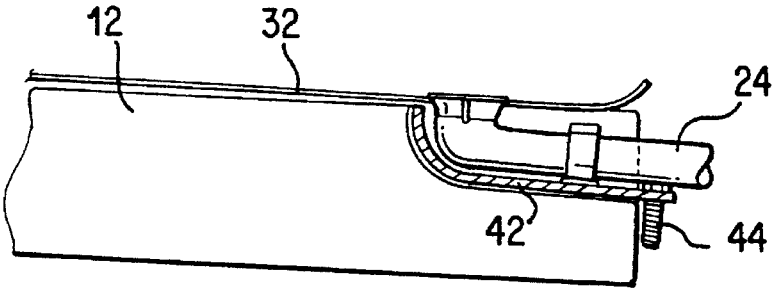
FIG. 6 is a longitudinal cross-sectional view showing another aspect of the mattress compressing device.

In the same manner that a new bed sheet is put on, a waterproof mattress pad (MA) is spread over the bed mattress (BM). A drainage socket (AS) is integrated in the center of the foot region of this mattress pad (MA). A highly flexible drainage tube is slipped—either bent at right angles or straight depending on the design of the bed— on this drainage socket (AS) (FIG. 6).

Figure 5:
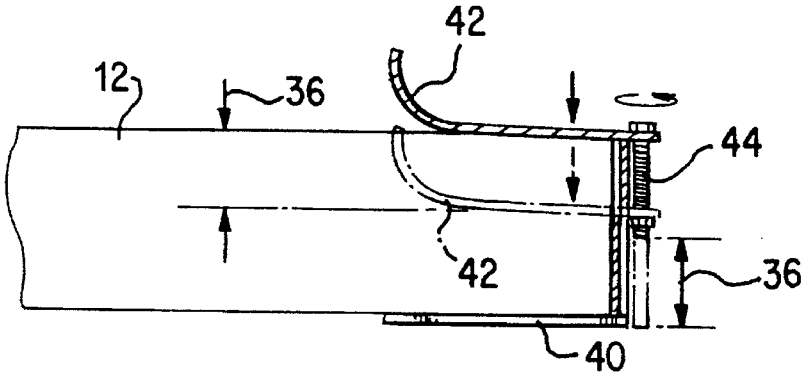
FIG. 5 is a longitudinal cross-sectional view of the mattress compressing device of FIG. 4.

To be able to impart to the drainage socket (AS) and tube fitting a constant gradient to the waterproof mattress pad (MA), it is necessary to produce a depression (V) in the conventional bed mattress (BM). This depression (V) should be designed so as to be protective and eliminatable (FIG. 5). For this purpose, an important part of the invention—the so-called mattress compressing device (MPV)—is suitable. This pad element is constructed in such a manner that an angular, large-area submattress plate (UB) holds a small-area mattress compressing element (MZ) and pulls it toward itself by rotating a vertical threaded rod (GS), so that a depression (V) is produced in the center of the foot end on the upper surface of the mattress (FIG. 5). The threaded rod (GS) can be operated by means of a small handcrank that can be mounted.

This mattress compressing device (MPV) can remain at the foot end of the bed mattress (BM), when frequent washings are necessary.

I claim:

1. A wash water draining device to be disposed beneath a waterproof bed mattress having opposed sides, a head end, and a foot end, for use when washing a patient in bed, said device comprising:

(A) a mattress base which is deformable in the shape of a basin to thereby cause the mattress to slope from the sides to the center and from the head end to the foot end;

(B) a waterproof mattress pad to be superimposed over the mattress, said mattress pad having a drainage socket at one end thereof, said one end to be placed over the foot end of the mattress; and (C) a mattress compressing device which is attached centrally to the foot end of the mattress to create a stabilized depression therein, whereby said drainage socket of said mattress pad can be embedded into the depression in the mattress.

2. A wash water draining device as claimed in claim 1, wherein the mattress base comprises inflatable chambers with air volumes chosen such that, in the inflated state, they cause the mattress to slope both from the sides to the center and from the head end to the foot end.

3. A wash water draining device as claimed in claim 1, wherein the mattress base comprises foam pieces configured such that, when they are put under both sides of said mattress, they cause the mattress to slope both from the sides to the center and from the head end to the foot end.

4. A wash water draining device as claimed in claim 1, wherein the mattress base comprises a slatted base both sides of which can be folded up, and means for causing the center piece of the slatted base to be lifted in the region of the head end when a side piece of the slatted base is folded up, whereby an additional stabilized gradient in the direction of the foot end is created in the center region of the mattress.

5. A wash water draining device as claimed in claim 4, wherein the sides of the slatted base can be raised or lowered electrically.

6. A wash water draining device as claimed in claim 4, wherein the sides of the slatted base can be raised or lowered manually.

7. A wash water draining device as claimed in claim 1, wherein the drainage socket is integrated at the foot end into the waterproof mattress pad and a drainage tube is fixed to said drainage socket.

8. A wash water draining device as claimed in claim 1, wherein the mattress compressing device comprises an angular, large-area sub mattress plate disposed beneath the mattress, a small-area mattress compressing element disposed on top of the mattress, a vertical threaded rod connecting said sub mattress plate and said mattress compressing element, whereby when said threaded rod is rotated, a depression is produced in the center of the foot end of the mattress on the upper surface thereof.

* * * * *